United States Patent [19]

Edmonds et al.

[11] 4,284,306

[45] Aug. 18, 1981

[54] APPARATUS AND METHOD OF MINING SUBTERRANEAN RUBBLE PILES

[75] Inventors: Byron P. Edmonds, Denver, Colo.; Selby W. Porter, Calgary, Canada

[73] Assignee: PPG Industries Canada Ltd., Regina, Canada

[21] Appl. No.: 57,861

[22] Filed: Jul. 16, 1979

[51] Int. Cl.[3] ..... E21B 43/28

[52] U.S. Cl. ..... 299/5; 175/57

[58] Field of Search ..... 299/4, 5, 2; 175/22, 175/23, 57, 171, 294

[56] References Cited

U.S. PATENT DOCUMENTS

| | | | |
|---|---|---|---|
| 1,905,497 | 4/1933 | Peters | 175/57 |
| 3,495,875 | 2/1970 | Dahms et al. | 299/5 |
| 3,556,597 | 1/1971 | Porter | 299/5 |
| 3,578,808 | 5/1971 | Edmonds et al. | 299/4 |
| 3,600,039 | 8/1971 | Porter | 299/5 |
| 3,603,095 | 9/1971 | Hendrix | 299/5 X |
| 3,637,261 | 1/1972 | Porter | 299/5 |

*Primary Examiner*—Ernest R. Purser

*Attorney, Agent, or Firm*—Irwin M. Stein; Walter M. Benjamin

[57] ABSTRACT

Disclosed is a method of solution mining the mineral content of a subterranean cavity containing a rubble pile positioned on the floor thereof and the subterranean cavity communicating with the surface by at least two boreholes, by drilling a liner through a cased borehole into the rubble pile, disconnecting the drill string from the liner, withdrawing the drill string from the borehole, introducing into the borehole a sealing meant to seal the annular space between the liner and the casing, introducing a solvent into the cavity and withdrawing from the cavity a solution enriched in the mineral contained in the rubble.

11 Claims, 3 Drawing Figures

APPARATUS AND METHOD OF MINING SUBTERRANEAN RUBBLE PILES

BACKGROUND OF THE INVENTION

This invention relates to an apparatus and method for solution mining a subterranean deposit of soluble minerals. More particularly, this invention relates to an apparatus and method whereby a subterranean cavity containing a rubble pile within a cavity in the deposit is mined.

Subterranean deposits of minerals such as sodium chloride, potassium chloride, magnesium chloride, trona, limestone, mixtures thereof and the like are solution mined by solubilizing the deposits with a suitable solvent and withdrawing from the deposit an enriched solution from which the minerals can be produced. Consequently, large cavities are created where the minerals have been vacated. Frequently, these cavities become so large that the roofs thereof collapse, thereby creating a rubble pile containing soluble and insoluble minerals. It may be desirable to recover a portion of the rubbilized desirable soluble minerals which may be in co-existence with other soluble minerals as well as the insolubles. Unfortunately, unless a conduit penetrates the rubble, it is difficult to mine because the desirable minerals are buried beneath insolubles and undesirable soluble minerals, resulting in a small surface area of the desirable mineral exposed to the action of unsaturated solvent.

In some cases the rubble pile will be intentionally created to increase the exposed surface area of the desired mineral. But, after mining for some time, the rubble pile becomes impermeable to the solvent owing to an accumulation of insolubles and/or owing to an increased ratio of an undesirable soluble mineral present.

It is therefore desirable to penetrate the rubble pile with a liner or tubing to introduce solvent into the rubble pile and dissolve the desired mineral content therein or to withdraw enriched solution from within the rubble pile. Because of the difficulty in drilling a hole in the rubble pile and subsequently setting a liner therein owing to the drilled hole caving in and owing to the hole being a small target at great depths, a drill down liner and wash down liner have been introduced to the art in U.S. Pat. Nos. 3,600,039 and 3,556,597 respectively.

The drill down liner of U.S. Pat. No. 3,600,039 allows the liner to be set along with packers which seal the annular space between the casing and the liner. Thrust bearings at the ends of the liner allow drilling to take place without the liner also turning, thereby reducing the amount of damage to the liner and packers. However, the drilling string does experience axial force which sometimes unavoidably causes damage to the packers. Also, the drill string must be removed to allow a large volume to be withdrawn. This removal operation is very cumbersome.

The wash down liner of U.S. Pat. No. 3,556,597 works well only when it does not encounter insoluble material of sufficient size which blocks its progress. It is also blocked if it encounters junk pipe left in the rubble pile by previous operations. This junk pipe includes casings intentionally cut or liners or tubing which have broken off by roof cavings. The wash down liners are a cheap, easy, quick way to re-establish a return system when a cavity contains rubble composed of soluble material, but as the cavity becomes older, it fails owing to caving of insoluble roof material or owing to an excess of junk pipe in its path.

SUMMARY OF THE INVENTION

An apparatus and method has been developed whereby a liner can be drilled down into a rubble pile, disconnected from the drill string, and packer and other downhole apparatus equipment can be subsequently connected to the liner, all with an ease of operation. Accordingly, a quick release and easily engaged connector, such as a j-slot connector, is positioned between a drill string having for its lower end a liner suitable for mining the mineral content of the rubble pile. With the drill bit placed on the lower end of the liner, the liner is drilled down through the rubble pile to a point near the cavity floor and set by disconnecting the drill string at the connector. Subsequently, a packer assembly is run down the casing and connected via the same or more permanent connection capable of withstanding high pressures.

The better sealing permanent connector can be threads, for example, on the end of the disengaged male portion of a j-slot connector so it can be easily found when a sealing means such as a packer assembly is lowered into the casing to provide the seal for the annular space between the liner and the casing. Even further, the apparatus can be outfitted with a special bell sub for ease in "finding" the apparatus with fishing equipment in case the apparatus shifts.

This apparatus can be used for injecting solvent into the cavity or withdrawing solution from the cavity which contains soluble or insoluble rubble. However, it is particularly useful for withdrawing solution from the cavity since solution is typically withdrawn from near the bottom of the cavity. The apparatus is more particularly useful for mining potassium chloride from a deposit where potassium chloride and sodium chloride are the principal soluble minerals contained in the rubble and clay and rock are the insoluble minerals. The apparatus is equally useful for mining sodium chloride or other soluble minerals such as copper or uranium which are now being solution mined extensively.

BRIEF DESCRIPTION OF THE DRAWINGS

The invention will be more readily understood from the detailed description below made with reference to the accompanying drawings in which.

DETAILED DESCRIPTION OF THE INVENTION

In accordance with the present invention, a drill down liner suitable for solution mining the mineral content of a subterranean cavity containing a rubble pile located on the floor of the cavity communicating with the surface by one or more boreholes, is carried down a cased well by a quick release and easily engaged means connecting the liner to a drill string, e.g., connected by a j-slot connection. With a drill bit on the lower end of the liner, the liner is drilled down through a rubble pile to or near the floor of the cavity. The drill bit can then be removed from the liner, or holes may be perforated in the liner to provide communication at the desired level between the cavity and the liner. The drill string is disconnected from the liner by the quick release means and withdrawn from the well. A sealing means such as a packer assembly is then lowered down into the well to seal off the annular space between the liner and near the lowest portion of competent casing (if the casing extends below the rubble it should be cut off). This packer assembly can be connected to the liner by the same easy engaging means which can be made pressure tight by an O-ring or alternately it can be connected by threads to provide the pressure tight seal. The lowering means, such as drill string, is removed from the packer assembly by the easy engaging means. Once this packer assembly is in place, the liner can be used for circulation of solvent or enriched solution between the surface and near the floor of the subterranean cavity.

After depletion of a portion of the soluble mineral from the rubble pile or from the wall of the cavity, the liner may have a tendency to shift owing to an uneven distribution of solubles and insolubles in the rubble. This shifting can cause damage to the liner or even detach the liner from the casing. To avoid this problem, an anchor is run down the well along with the packer assembly so that after connection with the liner, the entire down hole apparatus can be anchored to the casing. Additionally, a setting sub may be utilized to set the packer and anchor assembly and subsequently sheared from the packer and anchor assembly so the setting string can be withdrawn from the well. Fluid can then be introduced into or withdrawn directly from the casing which, via the liner, communicates with the cavity. Further, the setting sub can be linked to the packer and anchor assembly by a bell sub so that once the setting sub and string is detached and withdrawn, the bell sub can aid in the use of a conventional fishing tool to find a shifted down hole apparatus.

Figure 1:
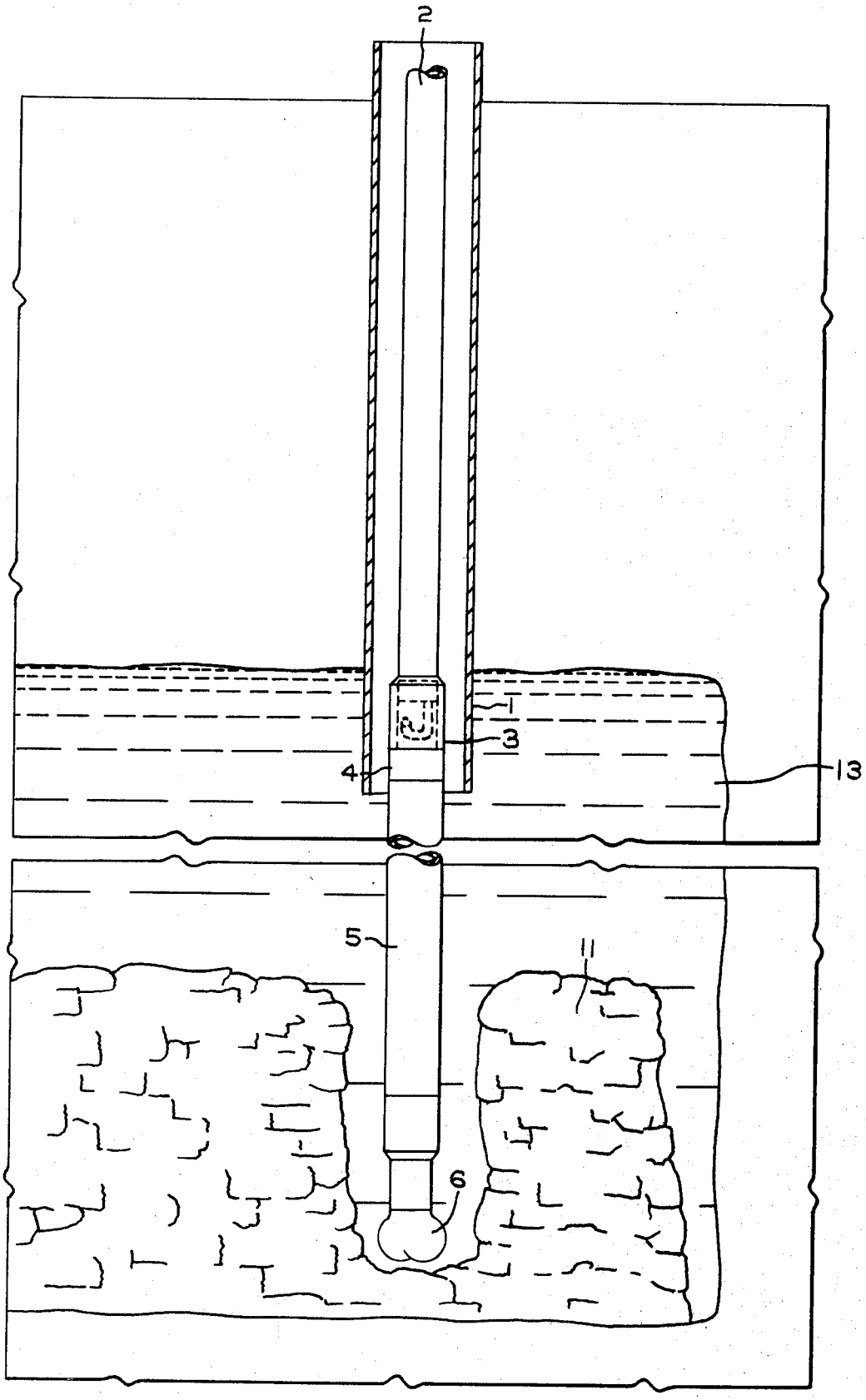
FIG. 1 is a diagramical illustration of a drill down liner assembly on a drill string.

Reference is now made to FIG. 1 which shows a drill string 2 connecting to liner 5 via a j-slot connection, the female portion 3 of which connects to the drill string 2 and the male portion 4 of which connects to liner 5. The j-slot connection is engaged by a dog and slot arrangement wherein the slot in the male portion 4 forms a "j" and the dog of the female portion 3 engages the "j" and is turned clockwise at the lower portion of the "j" to engage the small "hook" of the "j", by methods known in the mechanical art of quick-connecting/quick-disconnecting. The male and female portions can be sealed by providing an o-ring (not shown) between the two portions. A bit 6 is attached to the lower end of the liner 5. The liner is drilled down to a desired point near the floor of the cavity through a rubble pile 11 which may comprise soluble and insoluble minerals that can include clay and rock broken from formations overlying the cavity 13. At this time, the bit 6 may be cut away from liner 5 by explosives, mechanically or like methods or holes may be perforated in the lower part of liner 5, all of which cause communication between the cavity and the liner 5. Drill string 2 and the female portion 3 of the j-slot connection is removed by turning the drill counter-clockwise so the "dog" of the female portion 3 can follow the "j" slot out of the male portion 4 and the string withdrawn from the well bore. The liner 5 will usually stay freely standing in place so long as its upper portion is inside competent casing and its lower portion is secured by the rubble.

Figure 2:
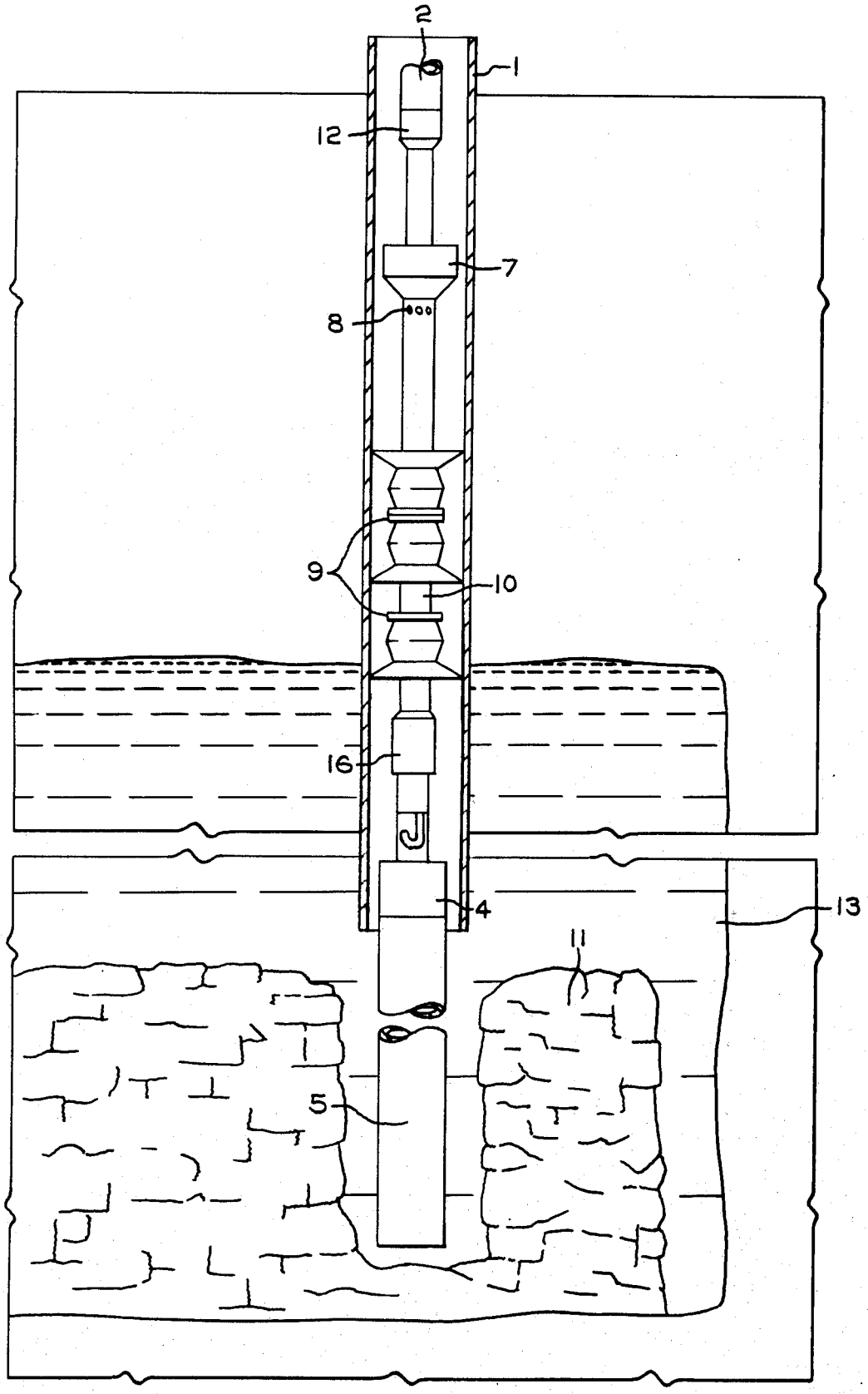
FIG. 2 is a diagramical illustration of a drill down liner assembly with a 3-cup packer assembly.

Reference is now made to FIG. 2 where like numbers refer to identical elements of FIG. 1 and which further shows packer assembly 9 mounted on mandrill 10 which is connected to the male portion 4 of the j-slot connection via a change over sub 16. Threads 18 are provided on the end of the male portion 4 of the j-slot connection so that once the female portion 3 and drill string 2 of FIG. 1 have been removed, threads 17 of the change over sub 16 engages the threads on the male portion 4 of the j-slot connection with a pressure tight connection. A setting sub 12 and bell sub 7 are used to lower the packer assembly 9 into the well via tubing 2. The setting sub 12 is secured to the bell sub 7 by shearing pins 8 to allow removal of drill string 2 after packer assembly 9 is attached to the liner assembly 5 and as a safety measure so that in case the packer assembly 9 is bound in casing 1, the string 2 can be withdrawn to make way for reworking operations. Bell sub 7 makes an easy target for conventional fishing tools to retrieve the down hole assembly.

Figure 3:
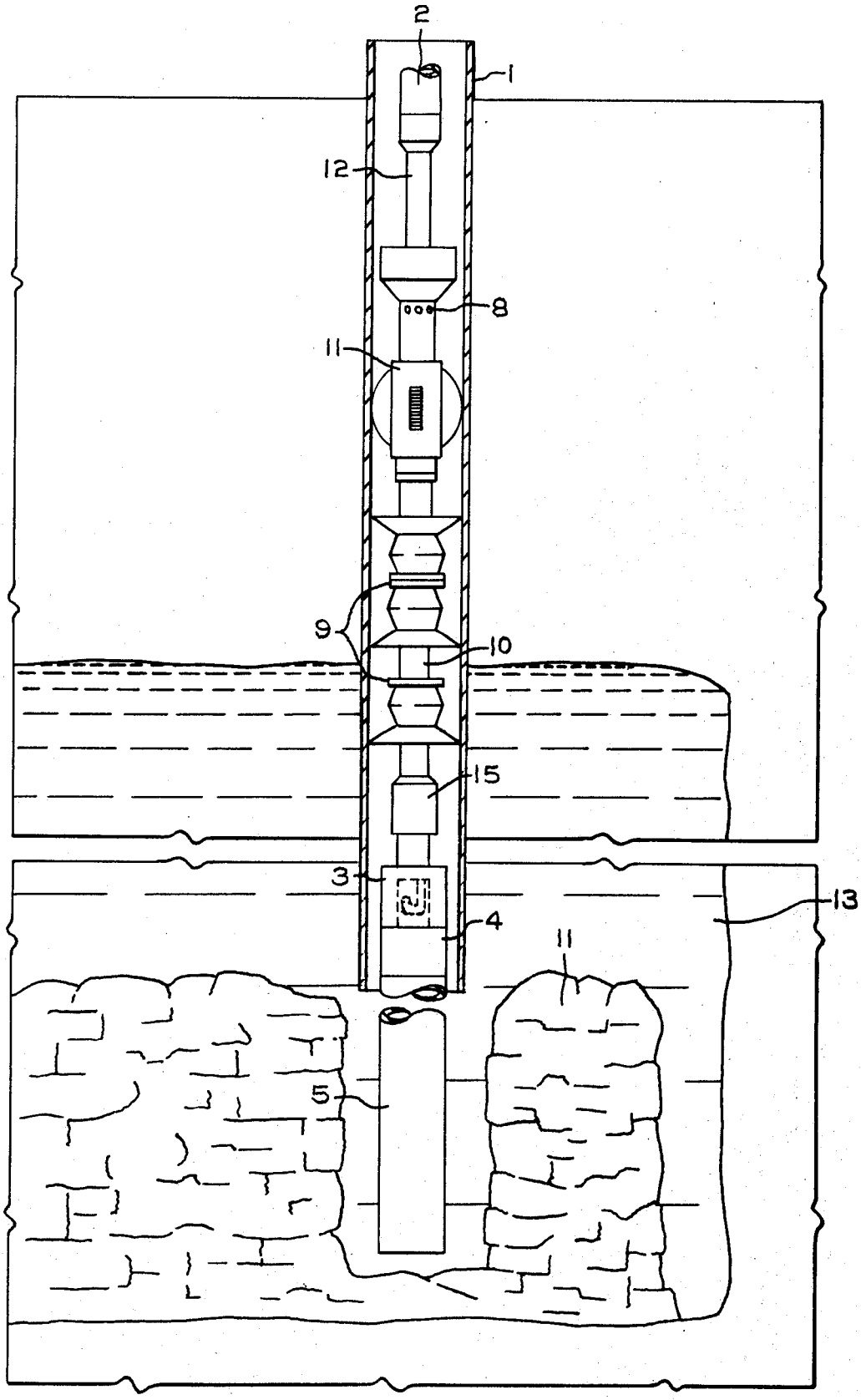
FIG. 3 is a diagramical illustration of a drill down liner assembly with a 3-cup packer assembly and anchor set.

Reference is now made to FIG. 3 where like numbers refer to like elements of FIG. 2 and which shows an anchor assembly 14 between the packer assembly 9 and bell sub 7. The anchor assembly 14 engages casing 1 to provide a stabilizing support for the entire lower down hole apparatus. FIG. 3 shows that the anchor assembly 14 and packer assembly 9 can be re-engaged with the male portion 4 of the j-slot connection via change over sub 15 and female portion 3. A pressure tight J-slot connection between female portion 3 and male portion 4 is possible with the use of o-rings disposed between the male and female portions.

In the operation of the apparatus in accordance with FIGS. 1, 2 and 3, the drill string 2, female and male portions 3 and 4 of the j-slot connection, liner 5 and bit 6 is assembled above ground having the configuration of FIG. I. The drill string 2 is introduced into subterranean cavity 13 and drilling into rubble pile 11 is begun. Drilling is continued until the bit 6 reaches near the floor of cavity 13. It can be drilled into the cavity floor to provide firm footing. The depth of the cavity can be determined by conventional logging techniques and will essentially be near the original cavity floor that existed before the rubble was created. Drilling is suspended once the bit has reached the desired depth and the bit is cut from the liner by conventional methods such as by a mechanical or explosive type cutter or the liner is perforated. The drill string is removed by turning the the dog counter-clockwise in the j-slot thus releasing dog from the slot. The j-slot, is designed for counter-clockwise removal so drilling can be done clockwise and with the drill string in tension. Liner 5 will be left free standing supported by rubble 11 and confined by the casing.

The packer assembly 9 of FIG. 2 is assembled above ground along with tubing string 2, setting sub 12, bell sub 7 and changeover sub 16. This string is lowered into casing 1 until change over sub 12 engages the free standing liner on the top of which is the male portion 4 of the j-slot connection. The change over sub 16 is mated with threads on the end of the male portion 4 of the j-slot connection. The packer assembly 9 seals the annular space between the mandrill 10 and casing 1 such that pressure can be developed within the cavity 13 through liner 5.

Alternately, instead of the assembly of FIG. 2, the assembly of FIG. 3 including tubing string 2, setting sub 12, bell sub 7, anchor assembly 14, packer assembly 9 and mandrill 10, change over sub 16 and female portion 3 of the j-slot connection are assembled above ground.

This string is lowered into casing 1 until the dog of the female portion 3 of the j-slot connection engages the j-slot of the male portion 4 of the j-slot connection on top of the free standing liner. The string is turned clockwise to set the dog of female portion 3 into the hook of the j-slot in male portion 4. The string is then turned further to engage anchor 14 against the walls of casing 1 (other methods of engaging an anchor are also possible). Tubing string 2 can then be withdrawn by shearing pins 8.

This invention is preferably useful in those instances where at least two wells are in communication with the cavity. The invention is possible with one well by introducing solvent through the annular space between casing 1 and string 2 of FIG. 1, and withdrawing solution through preforated string 5. Preferably, the present invention is utilized in a larger cavity in which a rubble pile has been formed. The liner is set in the rubble pile near the floor of the cavity and solution or solvent is withdrawn from or introduced into the cavity via the liner and introduced or withdrawn from a second borehole which may or may not contain the apparatus of the present invention.

EXAMPLE

The drill down liner assembly of FIG. 1 having a liner, longer than the depth of the cavity, was drilled into a cavity containing rubble substantially filling the cavity. The rubble comprised potassium chloride, sodium chloride, clay, rock, etc. The liner was drilled down until it was about two meters from the floor of the cavity. The drill string was then disconnected from the liner at the female portion of the j-slot connection. A change over sub, packer assembly, bell sub, setting sub and tubing string was assembled above ground. The string containing this apparatus was lowered into the casing and engaged the male portion of the j-slot connection and the change over sub was mated with the threads on the male portion of the j-slot connection until pressure tight. A solvent unsaturated with respect to potassium chloride was introduced into the cavity through another borehole. The solvent percolated through the rubble dissolving potassium chloride therefrom. Solution enriched with respect to potassium chloride was withdrawn through the liner and up through the casing for recovery of potassium chloride.

This apparatus and method is useful for solution mining many minerals so long as the mineral is subject to rubble and can be dissolved by a solvent. Even where the rubble is insoluble, wall mining remains possible. Hence, while particular apparatus and methods have been described with reference to the specific embodiments herein described, it is of course to be understood that the invention is not to be so limited except insofar as appears in the accompanying claims.

What is claimed is:

1. A method of solution mining the mineral content of a subterranean cavity containing a rubble pile positioned on the floor thereof, the subterranean cavity communicating with the surface by one or more boreholes, comprising introducing into a cased borehole communicating with the cavity a drill string having a liner positioned on the lower end of the string and a drill bit positioned on the lower end of the liner, the drill string and liner being joined by quick release connecting means, drilling into the rubble pile to a predetermined depth, the upper portion of the liner being within competent casing, disconnecting the drill string from the liner by the quick release connecting means, withdrawing the drill string, establishing communication between the liner and the cavity, introducing sealing means into the borehole to seal off the annular space between the liner and the casing, connecting said sealing means to the liner, introducing solvent into the cavity and withdrawing from the cavity a solution enriched in the mineral contained in the cavity.

2. The method of claim 1, wherein the quick release connecting means comprise a dog in a j-slot.

3. The method of claim 1, wherein the enriched solution is withdrawn from the cavity through the liner and borehole.

4. The method of claim 1, wherein the solvent is introduced into the cavity through the borehole and liner.

5. The method of claim 1, wherein the sealing means connects to the liner by a quick release connecting means comprising a dog in a j-slot.

6. The method of claim 1, wherein the rubble contains a soluble mineral.

7. The method of claim 1, wherein the rubble contains an insoluble mineral.

8. The method of claim 1, wherein the sealing means is a packer assembly.

9. The method of claim 8, wherein the packer assembly connects to the quick release connecting means by threads.

10. The method of claim 9, wherein an anchoring means is introduced into the casing along with the packer assembly to secure the down hole apparatus with respect to the casing.

11. The method of claim 10, wherein the apparatus includes a setting sub attached by shear pins and which further comprises shearing the setting sub from the down hole apparatus and withdrawing the drill string used for introducing the down hole apparatus.

* * * * *